United States Patent [19]

Yost

[11] Patent Number: 4,570,366

[45] Date of Patent: Feb. 18, 1986

[54] SNOWPLOW AND BLADE HAVING TRIANGULAR ROTATABLE CUTTING BLOCK TEETH

[76] Inventor: Kenneth J. Yost, 10 Candy Ct., Eaton, Ohio 45320

[21] Appl. No.: 639,568

[22] Filed: Aug. 10, 1984

[51] Int. Cl.[4] ..... E01H 5/04

[52] U.S. Cl. ..... 37/232; 37/141 T; 37/270; 172/701.1

[58] Field of Search ..... 37/232, 233, 264, 270, 37/271, 266, 141 R, 141 T, 142 R, 142 T; 172/614, 684, 701.1, 701.3, 715, 719

[56] References Cited

U.S. PATENT DOCUMENTS

| | | | |
|---|---|---|---|
| 1,383,409 | 7/1921 | Liddell | 37/233 |
| 1,406,993 | 2/1922 | McConley | 37/270 |
| 1,543,222 | 6/1925 | McVeety | 172/701.3 |
| 1,776,788 | 9/1930 | Gettelman | 37/232 |
| 1,890,730 | 12/1932 | Hunt | 37/271 |
| 2,061,585 | 11/1936 | Meyer | 37/233 |
| 2,431,410 | 11/1947 | Maxim | 37/270 |
| 3,283,426 | 11/1966 | Payne | 37/141 R |
| 3,512,284 | 5/1970 | Haynes | 37/141 R |
| 3,914,885 | 10/1975 | Moreau | 37/141 R |
| 4,255,878 | 3/1981 | Mahler et al. | 37/232 |
| 4,259,794 | 4/1981 | Rath | 37/232 |

FOREIGN PATENT DOCUMENTS

| | | | |
|---|---|---|---|
| 1243526 | 9/1960 | France | 37/232 |
| 2432067 | 3/1980 | France | 37/232 |
| 402584 | 12/1933 | United Kingdom | 37/232 |
| 573102 | 11/1945 | United Kingdom | 37/266 |
| 975035 | 11/1964 | United Kingdom | 37/232 |
| 461209 | 2/1975 | U.S.S.R. | 37/270 |

*Primary Examiner*—E. H. Eickholt

*Attorney, Agent, or Firm*—Killworth, Gottman, Hagan & Schaeff

[57] ABSTRACT

A long wearing plow blade which automatically overrides road surface irregularities and obstacles and returns to a snow-engaging position is provided which may be mounted on either the moldboard of a conventional snow plow or on the plow of the present invention. The improved snow plow of the present invention has a substantially horizontal deck trailing the plow blade. A vertically extending deflector baffle with a forwardly-extending upper lip which is integral with the deck guides snow to the side of the plow. The deflector baffle initially tangentially contacts snow being plowed, and in combination with the deck, results in a plow which is less susceptible to the formation of vision-obscuring clouds of snow and side slip when in use.

12 Claims, 13 Drawing Figures

FIG.1
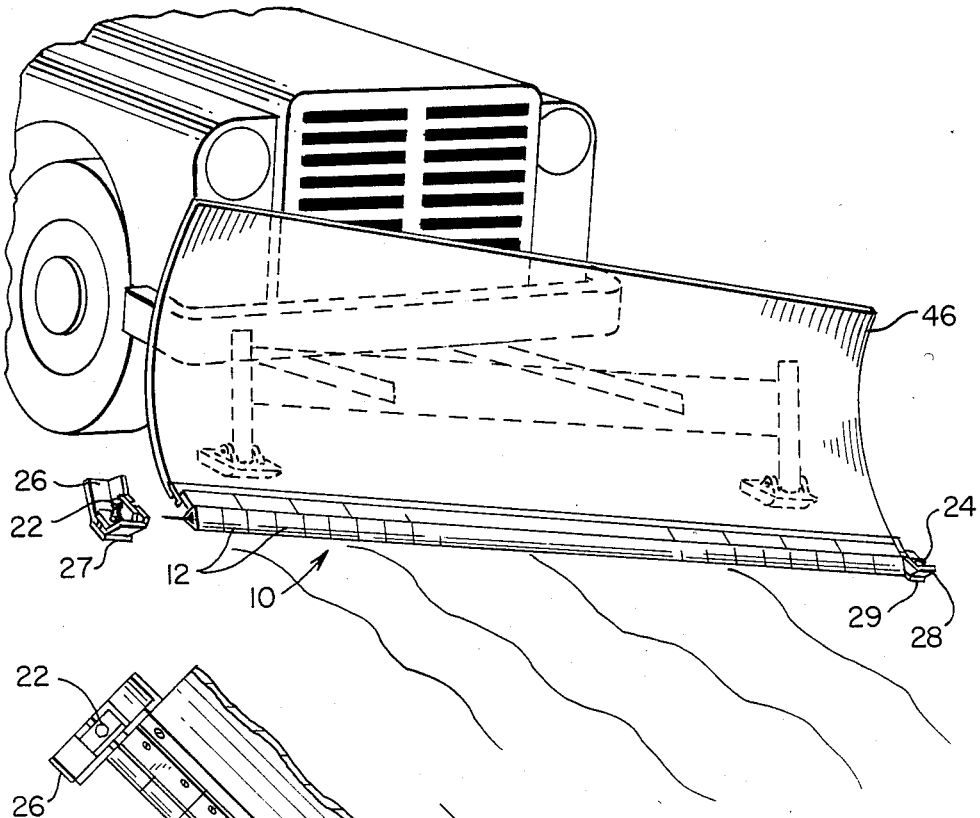
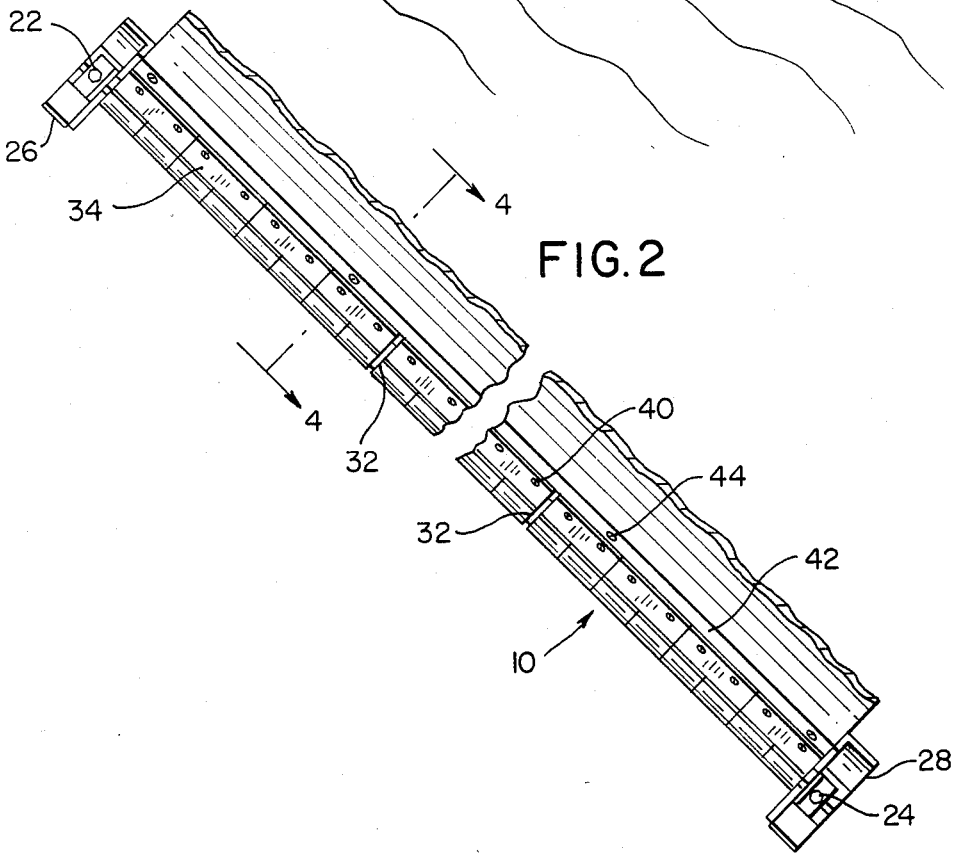
FIG.2

SNOWPLOW AND BLADE HAVING TRIANGULAR ROTATABLE CUTTING BLOCK TEETH

BACKGROUND OF THE INVENTION

This invention relates to a material handling plow and long-wearing blade therefor, and more particularly to a plow design and blade which overrides road surface irregularities and relatively immovable objects and automatically resets to a snow-engaging position without damage to the blade or road surface.

It is common to provide snowplow attachments on vehicular-mounted plows with safety release arrangements for releasing the blade and/or plow when a relatively immovable object is encountered. In these arrangements, either the scraping surface of the plow blade or the entire plow blade is pivotally mounted so that when a relatively immovable object or road surface irregularity is encountered, the plow blade rotates to "walk over" the object or surface irregularity. The blade must then be either manually or automatically reset to its normal operating position by the vehicle operator. Examples of such safety release arrangements are discussed in Kahlbacher, U.S. Pat. No. 3,626,614, and Gove, Sr., U.S. Pat. No. 3,775,877. However, even with such safety arrangements, the plow may have a tendency to jam on occasion resulting in personal injury to the operator and damage to the road surface, obstacle, plow and/or vehicle on which the plow is mounted.

Additionally, conventional snowplow blades are subject to rapid wear because of the weight of the plow bearing on the blade as it passes over abrasive road surfaces, To avoid rapid wear, conventional blades must be positioned above the road surface resulting in a layer of snow being left on the road surface after plowing. Expensive chemicals must then be applied to remove the remaining snow. Maintenance and replacement costs for conventional plows as well as down time for repair, maintenance and/or replacement are not insubstantial.

Additionally, conventionally-designed snowplow blades generate wind and air turbulence as they are pushed along road surfaces. This wind and turbulence tends to carry a fine cloud of snow above the plow which obscures the vehicle operator's vision and may result in traffic accidents. Moreover, this cloud of snow then resettles back to the road surface after the plow has passed.

Finally, conventional snowplow blades are subject to side slip which is caused by the resultant force from the angle of the plow blade relative to the direction of forward push against the layer of snow on a road surface. Such side slip may cause the vehicle on which the plow is mounted to leave the road and result in costly accidents and equipment damage.

Accordingly, the need exists in the art for a plow blade and plow of a design which overrides road surface irregularities and relatively immovable objects, minimizes wear on the blade, cleans the road surface substantially free of snow and substantially eliminates the formation of clouds of snow and side slip of the plow when in use.

SUMMARY OF THE INVENTION

The improved blade and plow design of the present invention meet those needs by providing a long wearing blade which automatically overrides obstacles or irregularities when they are encountered and returns to a snow-engaging position and by providing a plow which clears snow from road surfaces and the like but which is not as subject to the generation of clouds of snow and side slippage as conventional plows.

The blade assembly of the present invention includes at least one, and preferably a plurality of, blocks having triangular-shaped cross-sections. When more than one block is utilized, they are preferably arranged in side-by-side relationship along the length of the blade assembly. Each block has a leading edge and associated upward deflecting surface for engaging snow to be plowed, a trailing edge, and an upper edge.

The block or blocks which comprise the blade are mounted such that when the leading edge of a block encounters an obstacle or surface irregularity, the block rotates so that the leading edge turns under (rotates rearwardly of the direction of movement of the blade) enabling the block and blade assembly to override the obstacle and then return to the snow-engaging position. Thus, upon rotation, the leading edge of the block becomes the trailing edge, the trailing edge becomes the upper edge, and the upper edge becomes the new leading edge. The blade is long wearing because each block has three bearing surface and three edges which are utilized. Additionally, the blocks may be turned by hand to insure even wear on all three surfaces. The blocks are self-sharpening is use. Loose or out of position blocks can be detected by an optional detection device and circuit.

Because the blocks bear directly on the road surface, the blade of the present invention is able to remove substantially all of the snow on the road surface. The minute layer of snow left on the road surface by the blade acts to lubricate the blocks as they ride along the road surface. This minute layer of snow is quickly dissipated by traffic on the road. Thus, the blade of the present invention substantially eliminates the need for the application of road chemicals, salt, and grit which results in cost savings as well as eliminating the adverse environmental impact of such chemicals on nearby plants, animals, and water supplies.

In a preferred embodiment of the invention, the means mounting the block or blocks on the blade assembly includes a flexible cable or metal rod which passes laterally through the block or blocks and which is secured to opposite ends of the blade assembly. In this manner, when a plurality of blocks in mounted on the blade assembly, they are capable of rotating independently of each other.

The blade assembly also includes means for attaching it to the moldboard of a conventional snowplow. Such means can include a moldboard overlapping edge on the blade assembly which is secured by bolts or the like to the moldboard.

Finally, the blade assembly may also include a blade lip structure which extends into the gap between the moldboard overlapping edge and the upper edges of the blocks. The blade lip may be formed using a strip of a resilient material such as neoprene rubber or may be a thin gauge metal. In one embodiment, the blade lip is arranged to bear on the upper edge of a block while permitting to block to rotate when it encounters an obstacle or the like. The blade lip then urges the succeeding edge of the block back into a proper snow-engaging position. In that embodiment, the lip is held in a biased position by a coil or leaf spring. The spring permits the lip to yield for block rotation and then urge the lip back to its normal position.

The plow design of the present invention includes a substantially horizontally-oriented deck portion which trails the blade of the plow. The blade may be of a conventional design or may be the blade of the present invention. Integral with the deck is a substantially vertically extending deflector baffle structure which guides the snow rearwardly and then off to the side of the plow as the plow moves forward. Aiding in this guiding action is a forward-extending lip along the length of the top of the deflector baffle structure. This lip serves to deflect downwardly any snow which would otherwise escape above the top of the plow.

The leading edge of the deflector baffle is substantially parallel to the direction of movement of the plow so that, initially, the snow being plowed is contacted tangentially. The remainder of the deflector baffle structure gradually curves rearwardly and to the side so that the snow being plowed is gradually turned aside. While not wishing to be bound by any particular theory, it is believed that the structure of the present invention is less susceptible to side slip than previous plows in the art due to the substantially horizontal deck in combination with the deflector baffle means. Snow is initially tangentially contacted and loosened independently of the snow on the road surface ahead of the plow and is deposited on the deck. The forward motion of the plow in conjunction with the deflector baffle then causes the snow to be turned gradually to the side of the plow.

The deck of the plow of the present invention is supported off the road surface preferably by one or more caster wheels. These wheels may be pivotally mounted on the rear of the deck and deflector baffle structure. Also, there may be a hydraulic cylinder mounted on the pivot shaft of the caster wheel or wheels to aid in raising and lowering the plow and adjusting its operating height. This support lessens the weight bearing on the plow blade and increases its wear.

Because means are used to support the plow, the attachment of the plow to the front of a vehicle is simplified because less weight and stress will be placed on the front end of the vehicle. Mounting brackets may be used to mount the plow to the front end of the vehicle. Much lighter mounting brackets may be used than on conventional snowplows, and the plow of the present invention may be mounted to a front bumper rather than to the frame of the vehicle. Additionally, the plow requires less power to push through snow.

Finally, although the plow of the present invention has been described as a single unit, by combining a left-hand and right-hand unit, a V-shaped plow is formed which can be used to clear a much wider path in a single pass.

Accordingly, it is an object of the present invention to provide a long wearing plow blade which automatically overrides surface irregularities and obstacles and removes substantially all snow from road surfaces. It is a further object of the invention to provide a snowplow design which is less susceptible to the formation of clouds of snow and side slip than conventional plows. These and other objects and advantages of the invention will become apparent from the following detailed description, the accompanying drawings, and the appended claims.

BRIEF DESCRIPTION OF THE DRAWINGS

FIG. 1 is a perspective view of the plow blade of the present invention attached to a conventional plow and mounted on a vehicle;

FIG. 2 is a top plan view of the plow blade of the present invention;

DETAILED DESCRIPTION OF THE PREFERRED EMBODIMENTS

Figure 3A:
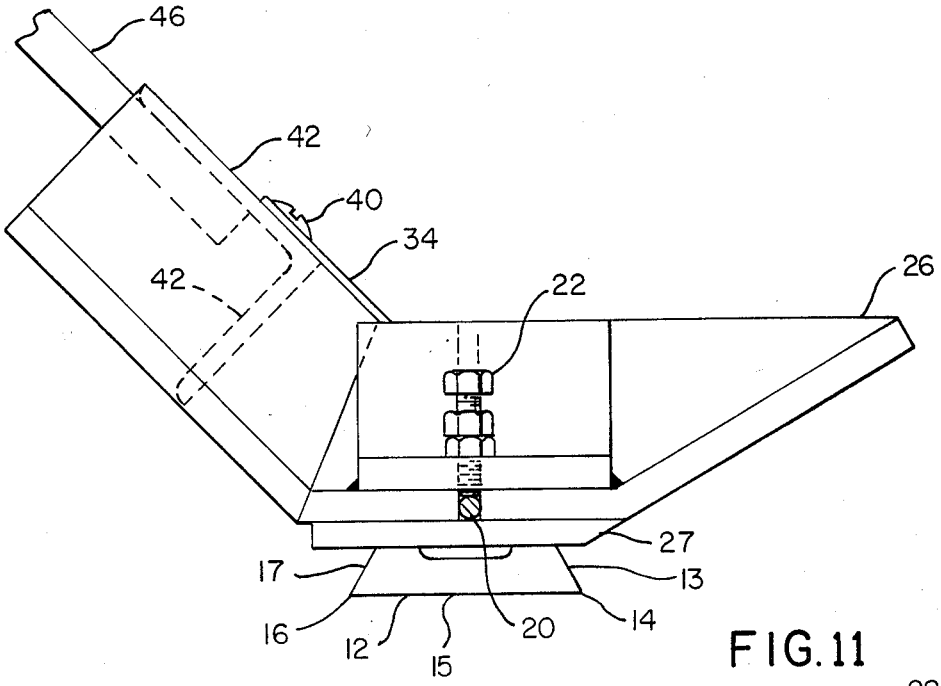
FIG. 3*a* is a detailed end view of the plow blade of the present invention.

Referring now to FIGS. 1–6 of the drawings, the blade 10 of the present invention is illustrated. Blade assembly 10 has plurality of blocks 12 of triangular-shaped cross-section. As can be seen, any number of these blocks 12 can be placed in side-by-side relationship to form a blade of any desired length. In a preferred embodiment, approximately 20 blocks each having a 6 inch length and substantially equilateral sides of approximately 3 to 3½ inches, respectively, may be positioned side by side to form a blade which is 12 feet in overall length. Of course, it will be recognized that larger or smaller blocks may be used to adapt the blade assembly to specific uses. For example, on rough or irregular road surfaces, the use of larger blocks would aid the plow in riding over such irregularities. The blocks 12 may be fabricated of metal or other suitable long wearing material.

Figure 6:
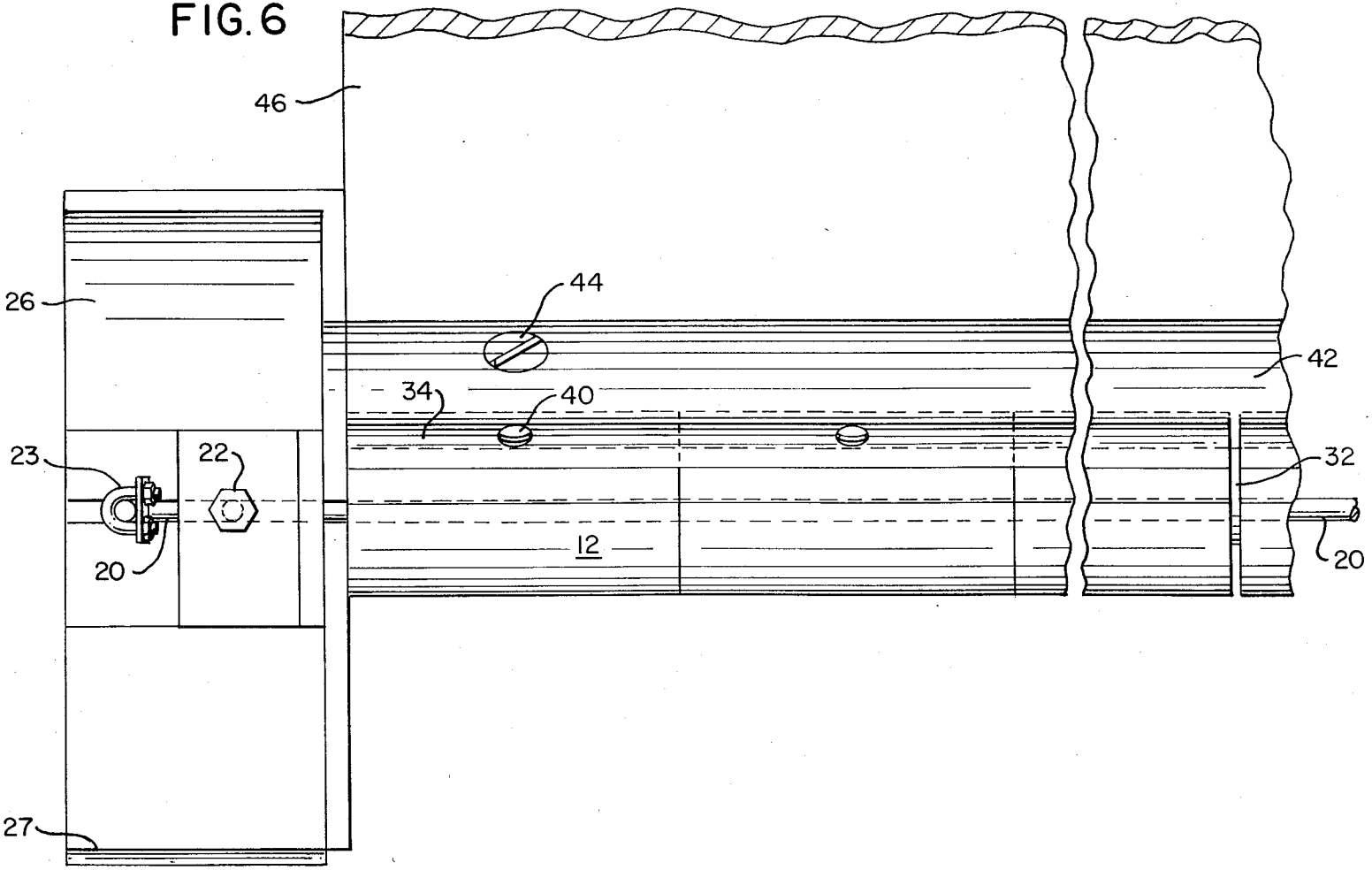
FIG. 6 is a detailed plan view showing the mounting of the block to form the plow blade.

Each block 12 has a leading edge 14 for engaging snow to be plowed, a trailing edge 16, and an upper edge 18 with associated surfaces 13, 15, and 17. As best illustrated in FIGS. 4*a* and 6, each block 12 has a generally triangular-shaped annular opening 19 extending laterally therethrough. In a preferred embodiment, a flexible metal cable or rod 20 passes through annular openings 19 in blocks 12 and is secured at opposite ends of the blade by screws 22 and 24 and clamps 23 and 25, respectively, positioned against end hangers 26 and 28. Cable end hangers 26 and 28 may have wear plates 27 and 29, respectively, bolted or otherwise fastened to their lower surfaces.

Figure 3B:
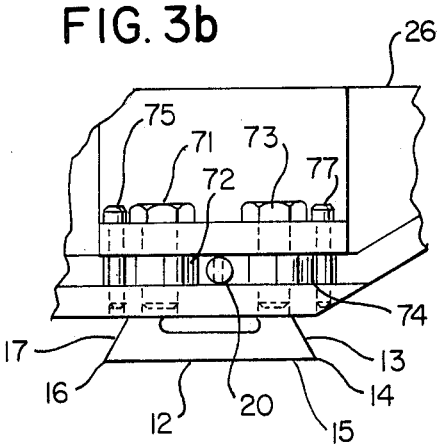
FIG. 3*b* is a detailed side view of an alternate cable clamping and tightening mechanism.

Alternatively, as illustrated in FIG. 3*b*, cable or rod 20 may be secured and tightened by a pair of opposed bolts 71, 73, each having interengaging mesh teeth 72, 74, respectively, which tightly hold cable 20 in position. After tightening, ratchet pins 75, 77 are dropped into place to lock the mesh teeth 72, 74 and prevent loosening of the cable.

For best operation, the cable or rod 20 is positioned against front edge 30 of annular opening 19 and somewhat below the top of opening 19. The positioning better maintains blocks 12 in proper snow-engaging position during operation and enables them to rotate when an obstacle is encountered and return to a snow-engaging position. Locating the cable at this position minimizes pavement marking or gouging when the block rotates and also prevents the blade assembly from being displaced upwardly when block rotation occurs. Further support for cable or rod 20 is provided by one or more intermediate hangers 32 positioned along the length of the blade. These hangers 32 may be secured to the lower surface of plow moldboard mounting bracket 42 by suitable means such as bolts 43 and 45.

In a preferred embodiment of the invention, which is illustrated in FIG. 4*a*, a blade lip structure 34, which extends the length of the blade assembly, extends downwardly toward blocks 12 from moldboard mounting bracket 42. Blade lip 34 may be formed of a resilient material such as neoprene rubber or may be a thin guage metal. Blade lip 34 reduces the gap between blocks 12 and moldboard mounting bracket 42 so that as snow is plowed, the snow will "jump" the remaining gap. Clearance is preferably maintained, however, between the tip of blade lip 34 and blocks 12 so that blocks 12 can freely rotate without impedance.

Figure 4B:
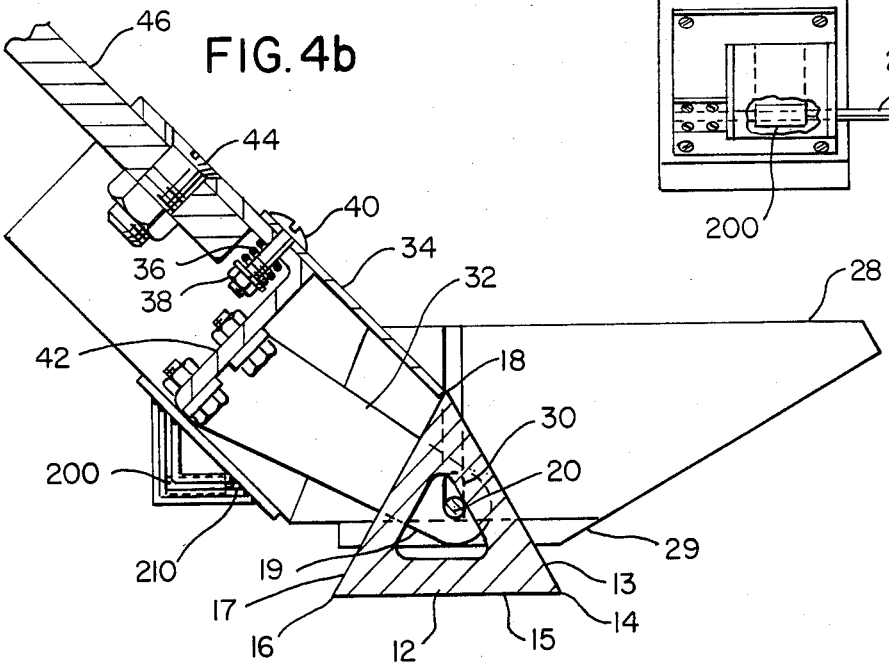
FIGS. 4*a* and 4*b* are detailed, sectional side views of alternative embodiments of the blade taken along line 4—4 of FIG. 1.
Figure 4A:
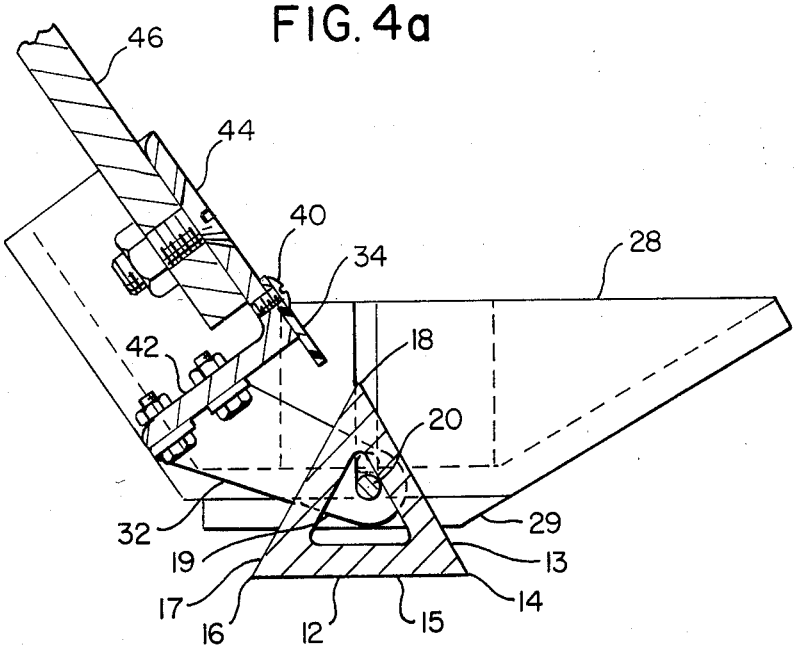
Figure 5:
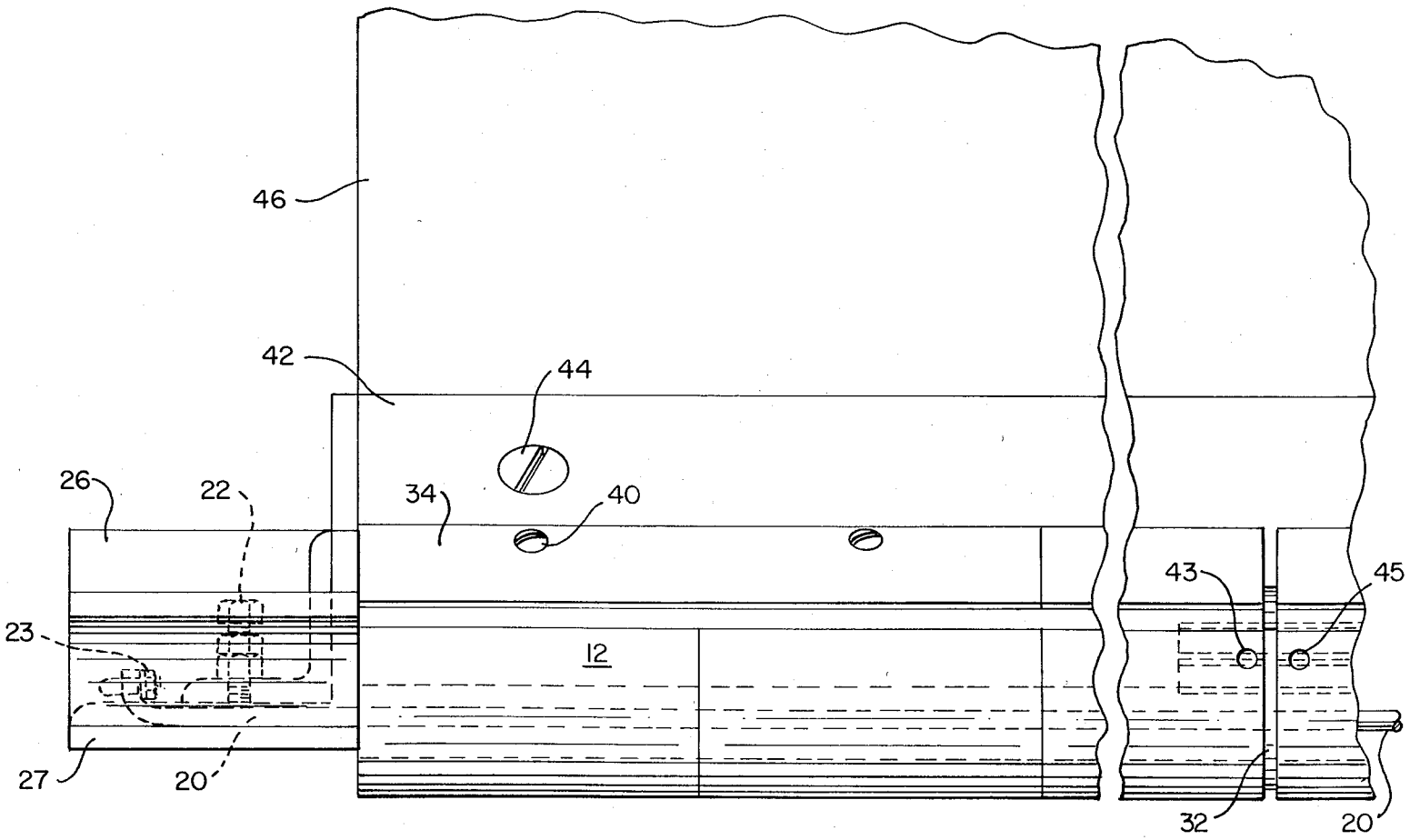
FIG. 5 is a detailed front view showing the mounting of the block to form the plow blade.

In an alternate embodiment, which is illustrated in FIG. 4*b*, blade lip 34 comprises a relatively thin but stiff strip of metal which extends along the length of the blade assembly and which bears against upper edges 18 of blocks 12. Blade lip 34 is biased against upper edges 18 by a compressed coil spring 36 mounted on nut 38 and bolt 40. Nut and bolt arrangement 38, 40 also serves to attach blade lip 34 to L-shaped plow moldboard mounting bracket 42. Mounting bracket 42 may in turn be secured by suitable means such as bolts 44 to the moldboard 46 of a conventional plow or to the plow structure of the present invention as described in further detail below.

Blocks 12, when mounted in the manner described above, or in any other suitable manner, are capable of rotating independently of one another. Thus, as the blade assembly is advanced along a road surface or the like, the bottoms of the blocks bear on the road surface and leading edges 14 shave the snow from the road surface. When a surface irregularity or substantially immovable object is encountered by the leading edge of one or more of the blocks 12, each block is able to rotate clockwise so that the block automatically overrides the irregularity or obstacle and returns to a snow-engaging position. That is, upon encountering an obstacle, leading edge 14 of block 12 rotates rearwardly of the direction of movement of the blade and becomes the new trailing edge of the block. Upper edge 18 is rotated downwardly into a snow-engaging position and becomes the new leading edge.

Because each block 12 has three surfaces which are capable of bearing on the road surface while a leading edge of the block is presented, blade assembly 10 is much longer wearing than previous conventional blades. Additionaly, to insure even wear on all block surfaces, the blocks may be periodically turned by hand. Finally, the blocks my be periodically coated or recoated with fiberglass, metal, ceramic, or other suitable material to build up worn surfaces.

Figure 11:
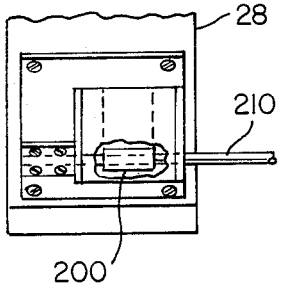
FIG. 11 is a detailed side view of a broken or loose block detector.

Optionally, a detection device and circuit as illustrated in FIG. 11 can be installed behind blocks 12 to detect loose or broken blocks. The device comprises a thin flexible cable 210 stretched behind blocks 12 and secured on end hangers 26 and 28. A microswitch assembly 200 is mounted on one of the end hangers and positioned behind the cable. When a loose or broken block strikes or presses against the cable 210, the cable, in turn, activates the microswitch 200 by pressing back against it and closing a circuit. The closing of the circuit then provides a warning or alert signal to the operator of the plow.

Referring now to FIGS. 7–10 of the drawings, where like structure elements are indicated by like reference numerals, the plow 100 of the present invention is illustrated. Plow 100 includes a blade 102, a substantially horizontally oriented deck portion 104, and, integral with deck portion 104, a substantially vertically extending deflector baffle 106 with top flange or lip 220. Blade 102 may be of a conventional design or may be the plow blade of the present invention as described in detail above.

Figure 9:
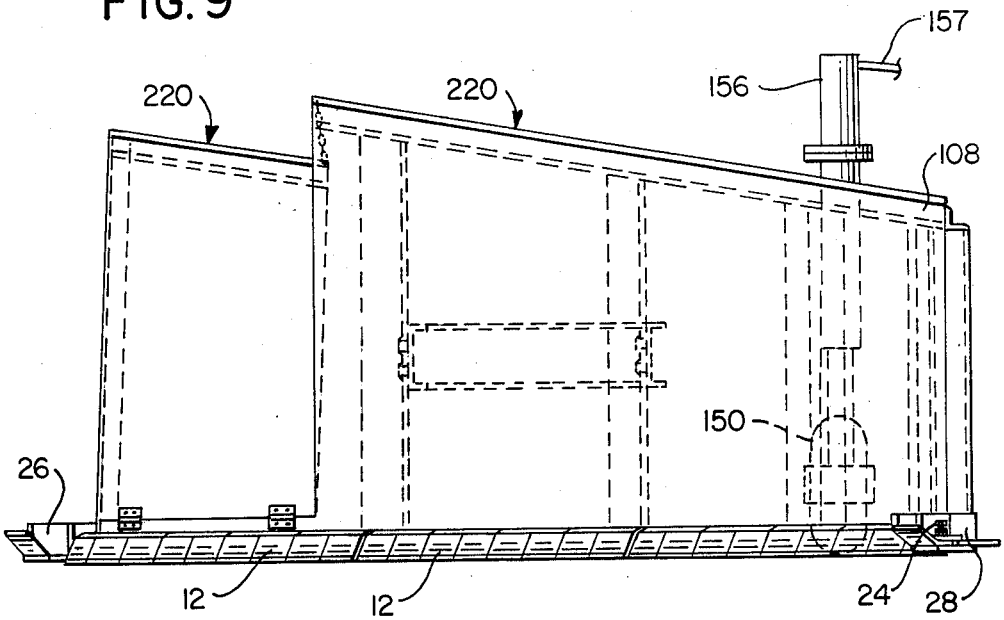
FIG. 9 is a front elevation view of the plow.

The leading edge 108 of the deflector baffle 106 is substantially parallel to the direction of movement of the plow so that the snow being plowed is initially contacted tangentially. The remainder of deflector baffle 106 is curved to turn the snow outwardly to the side of the plow. In a preferred embodiment, deflector baffle 106 is formed as an arc of a circle having an approximately nine foot radius. As best shown in FIG. 9, the height of deflector baffle 106 varies along its length from a minimum at leading edge 108 to a maximum at trailing edge 110. Further, forward-turned lip 220 is formed along the length of the top edge of deflector baffle 106 at an approximately 90° to 135° included angle to direct snow downwardly toward deck portion 104.

Figure 7:
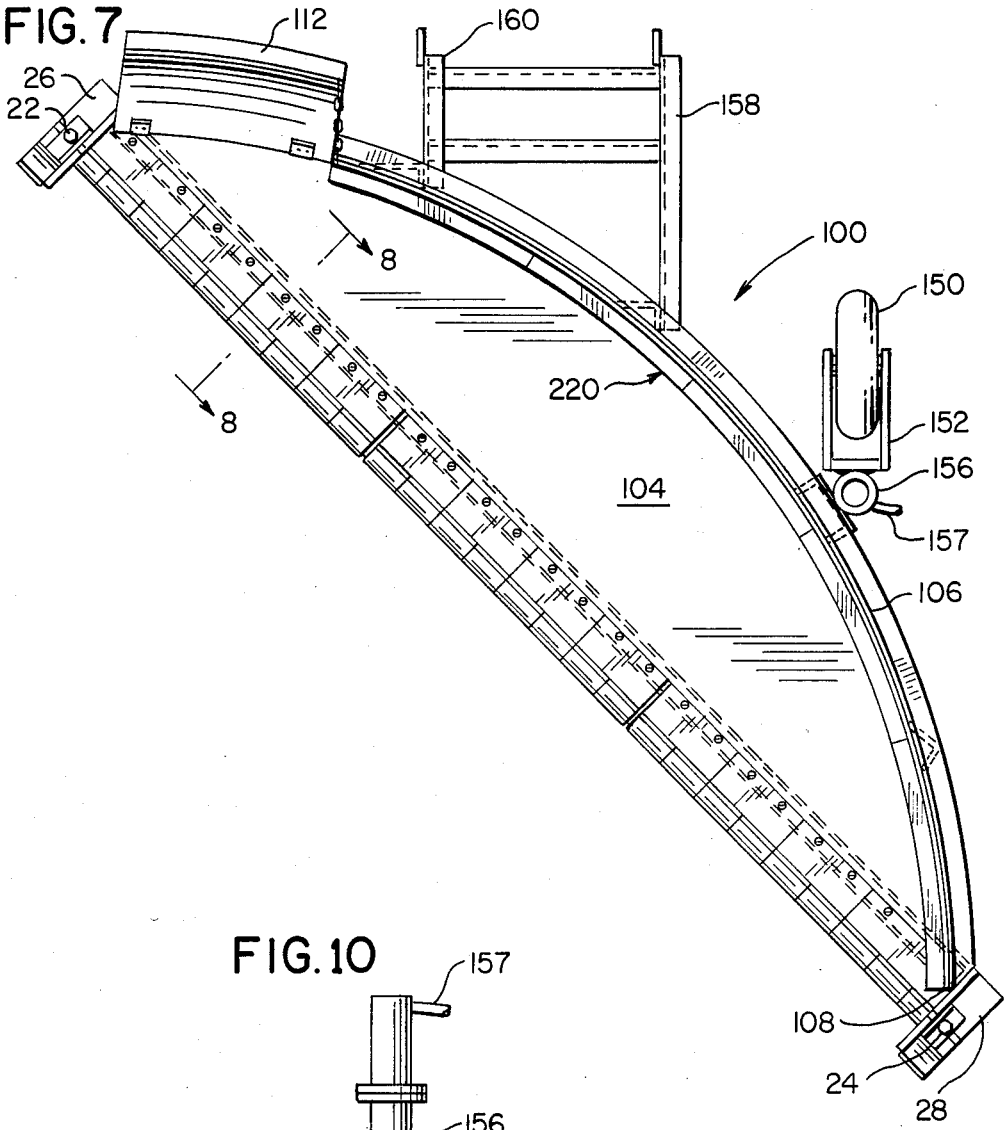
FIG. 7 is a top plan view of the plow of the present invention.
Figure 10:
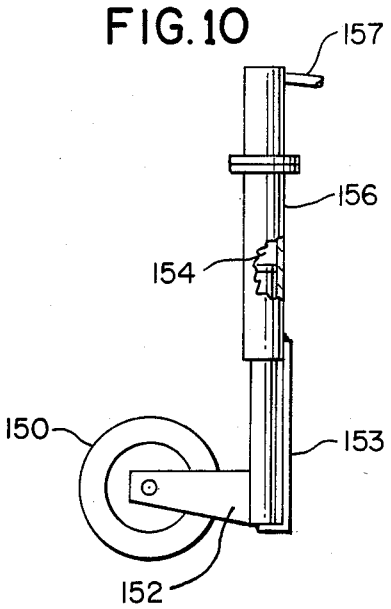
FIG. 10 is a side elevation view of the caster wheel and hydraulic cylinder mount.

This variation in height and the lip 220 at the top of the deflector aid in causing the snow to be thrown outwardly from the plow to the side of the road surface rather than upwardly above the plow. Also shown in FIGS. 7 and 9 is an optional baffle section 112 which may be hinged or otherwise made adjustable. Baffle section 112 may be tilted rearwardly of the plow and deflector baffle 106 to aid further in directing snow upwardly and outwardly away from the road surface.

Figure 8:
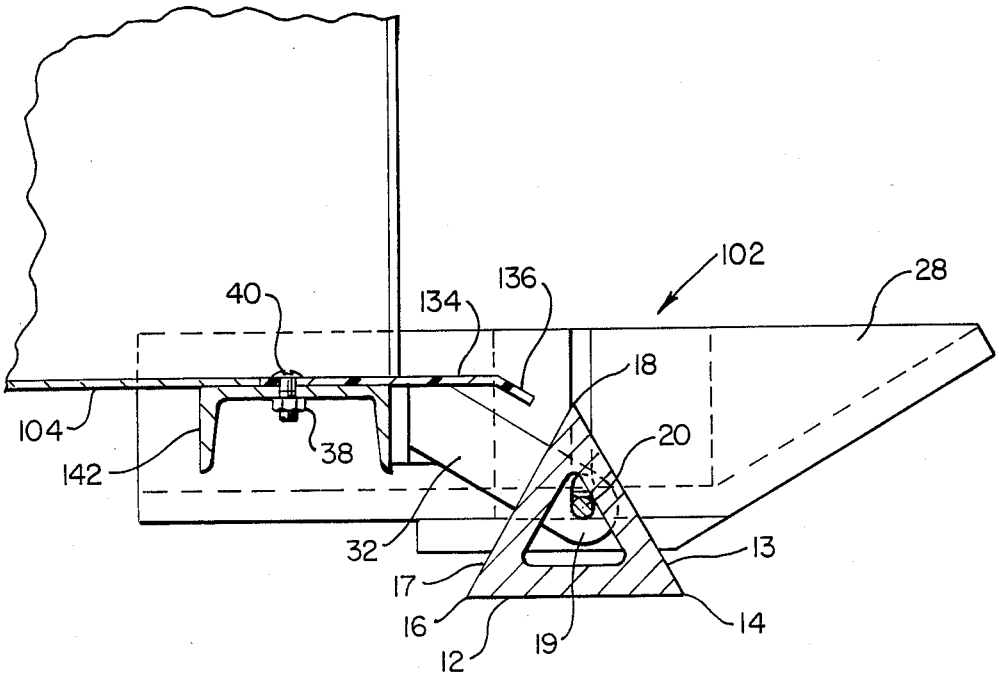
FIG. 8 is a detailed sectional view of the plow taken along line 8—8 in FIG. 7.

Referring now to FIG. 8, a preferred embodiment of the present invention is illustrated detailing the attachment of blade 102, having blocks 12, to deck portion 104 of the plow. A generally triangular-shaped annular opening 19 extending laterally through blocks 12 provides access for flexible metal cable or rod 20. The ends of cable or rod 20 are secured by screws 22 and 24, respectively, positioned against end hangers 26 and 28. Cable 20 is positioned against front edge 30 of annular opening 19, somewhat below the top of opening 19, for best operation.

In a preferred embodiment of the invention, illustrated in FIG. 8, deck lip 134 which extends the length of blade 102 also extends outwardly from deck portion 104 toward upper edges 18 of blocks 12. Deck lip 134 has an angled portion 136 which is bent downwardly toward blocks 12. Deck lip 134 may be formed of a resilient material such as neoprene rubber or may be a thin guage metal. Deck lip 134 reduces the gap between blocks 12 and deck portion 104 so that as snow is plowed, the snow will "jump" the remaining gap. Clearance is preferably maintained, however, between the tip of angled portion 136 and blocks 12 so that the blocks can freely rotate without impedance.

As shown, deck portion 104 of the plow is supported off the road surface by rear caster wheel 50 suitably mounted by bracket 152 and rotatable pivot shaft 153 onto the rear of deflector baffle 106. Caster wheel 150 is free to pivot and turn in conjunction with rotatable pivot shaft 153 as the plow is moved along a road surface to be plowed. A hydraulic cylinder 154 positioned within hollow pivot shaft 156 of caster wheel 150 aids in raising and lowering the plow and adjusting its operating height. Thus, the caster wheel assembly combines in a single compact unit the ability of both horizontal and vertical movement. This assembly eliminates the need for sliding shoes which are necessary on conventional plows. Control of the hydraulic cylinder by the plow operator is accomplished in a conventional manner known in the art through hydrualic fluid line 157. The plow is mounted to the frame and/or front bumper of a vehicle by brackets 158 and 160.

In operation, as plow 100 is moved forwardly, leading edge 108 of deflector baffle 106 initially tangentially contacts the snow so that no initial side forces are generated which would induce side slip of the plow. As the snow is removed from the road surface, it rests on deck portion 104 while it is gradually turned sidewardly by the gradual curvature of deflector baffle 106. This aerodynamically smooth movement of snow, in conjunction with lip 220 which redirects the snow downwardly, facilitates the controlled guidance of the snow off the road surface without upward escape of clouds of snow. This gradual camming action of the plow is further believed to result in less tendency for the plow to be subject to side slip.

Having described the invention in detail and by reference to the preferred embodiments thereof, it will be apparent that modifications and variations are possible without departing from the scope of the invention defined in the appended claims.

What is claimed is:

1. A blade assembly for attachment to the moldboard of a snowplow comprising:

at least one block forming a blade and having a triangular-shaped cross-section, said at least one block having a leading edge for engaging snow to be plowed;

means for mounting said at least one block on said blade assembly such that when said leading edge of said at least one block encounters an obstacle, said leading edge rotates rearwardly, overrides said obstacle, and returns the succeeding surface of said at least one block to a snow-engaging position: and means for attaching said blade assembly to the moldboard of a snowplow.

2. The blade assembly of claim 1 in which said means for mounting said at least one block is a flexible cable passing laterally through the interior of said at least one block and secured to opposite ends of said blade assembly.

3. The blade assembly of claim 1 in which said means for mounting said at least one block is a metal rod passing laterally through the interior of said at least one block and secured to opposite ends of said blade assembly.

4. The blade assembly of claim 1 including a plurality of blocks having triangular-shaped cross-sections mounted in side-by-side relationship and forming the blade along the length of said blade assembly.

5. The blade assembly of claim 1 including means for returning the succeeding surface of said at least one block to a snow-engaging position which comprises an elongated blade lip, said lip bearing on the upper edge of said at least one block.

6. The blade assembly of claim 5 in which said blade lip is maintained in position by a spring.

7. A snowplow for a vehicle comprising:

a blade assembly for plowing snow; said blade comprising at least one block forming a blade and having a triangular-shaped cross-section and a leading edge for engaging snow to be plowed, means for mounting said at least one block on said blade assembly such that when said leading edge of said at least one block encounters an obstacle, said leading edge rotates rearwardly, overrides said obstacle, and returns the succeeding surface of said at least one block to a snow-engaging position;

means for securing said blade assembly to a substantially horizontal deck trailing said blade;

substantially vertically extending deflector baffle means integral with said deck for guiding snow to the side of said plow, the leading edge of said deflector baffle means being substantially parallel to the direction of movement of said plow;

means mounted on said plow for supporting said deck and deflector baffle means and adjusting the height of said deck above the surface to be plowed; and means for mounting said plow to a vehicle.

8. The snowplow of claim 7 in which said deflector baffle means includes an elevator section having a rearward angular tilt to deflect snow upwardly as well as outwardly to the side of said plow.

9. The snowplow of claim 7 in which said deflector baffle means has a radius of curvature which directs snow rearwardly and outwardly from said plow.

10. The snowplow of claim 7 in which said means mounted on said plow for supporting said deck and deflector baffle means includes at least one caster wheel mounted on a rotatable pivot shaft and a hydraulic cylinder mounted on the top of said rotatable pivot shaft, said hydraulic cylinder raising and lowering said plow and said pivot shaft permitting horizontal rotation of said caster wheel.

11. The snowplow of claim 7 in which said deflector baffle means has a forward extending lip along the upper edge thereof for preventing upward escape of clouds of snow from the plow.

12. A snowplow for a vehicle comprising:

a plow moldboard;

a blade assembly comprising at least one block forming a blade and having a triangular-shaped cross-section, said at least one block having a leading edge for engaging snow to be plowed;

means for mounting said at least one block on said blade assembly such that when said leading edge of said at least one block encounters on obstacle, said leading edge rotates rearwardly, overrides said obstacle, and returns the succeeding surface of said at least one block to a snow-engaging position; and means for attaching said blade assembly to said moldboard of said snowplow.

* * * * *